United States Patent [19]

Young, Jr.

[11] 4,321,852

[45] Mar. 30, 1982

[54] STRINGED INSTRUMENT SYNTHESIZER APPARATUS

[76] Inventor: Leroy D. Young, Jr., 4850 SW. 91st Ave., Miami, Fla. 33165

[21] Appl. No.: 105,160

[22] Filed: Dec. 19, 1979

[51] Int. Cl.[3] ..... G10H 3/00

[52] U.S. Cl. ..... 84/1.16; 84/DIG. 30

[58] Field of Search ..... 84/1.16, 1.01, DIG. 30

[56] References Cited

U.S. PATENT DOCUMENTS

| | | | |
|---|---|---|---|
| 2,792,738 | 5/1957 | Donahue | 84/1.16 |
| 3,902,395 | 9/1975 | Avant | 84/1.16 |
| 4,202,234 | 5/1980 | Comerford | 84/1.01 |

*Primary Examiner*—Gene Z. Rubinson
*Assistant Examiner*—Forester W. Isen
*Attorney, Agent, or Firm*—Jackson, Jones & Price

[57] ABSTRACT

A musical instrument for cooperation with an electronic synthesizer having a parallel-control fretboard on a mountable neck member. Electronics associated with the neck member provide accurate volume, gate and frequency control signals for a synthesizer while still permitting normal guitar playing nuances such as hammer-offs, hammer-ons, slides, muting, and bends. A preferred embodiment employs a micro-processor and a multiple string fretboard.

12 Claims, 17 Drawing Figures

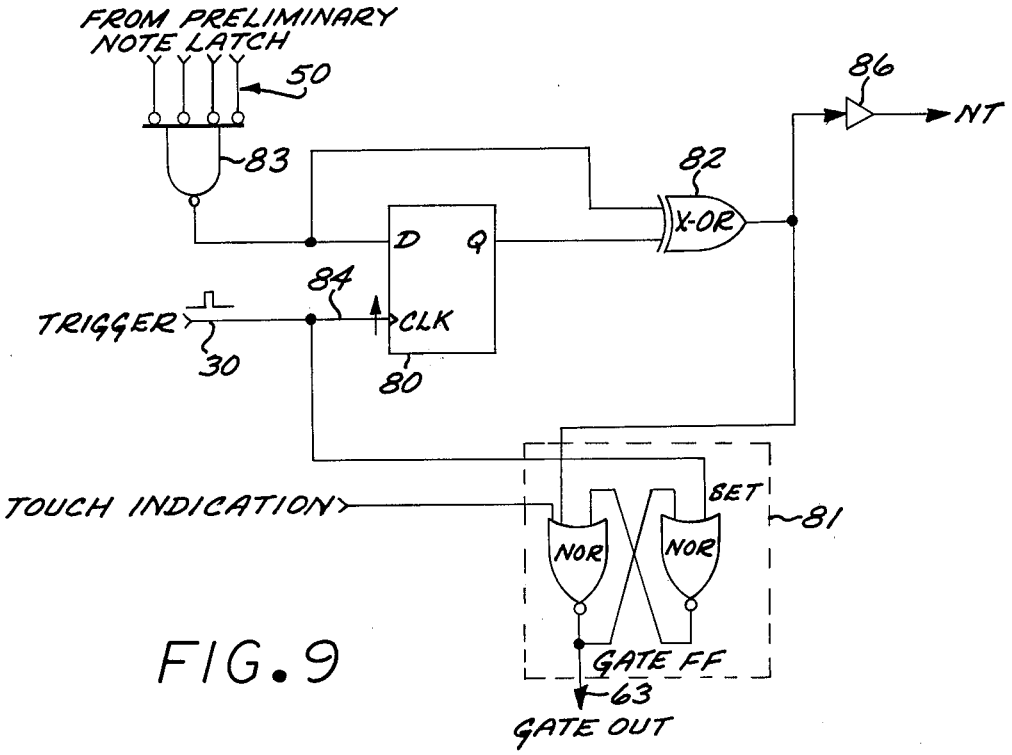
FIG. 9
FIG. 10
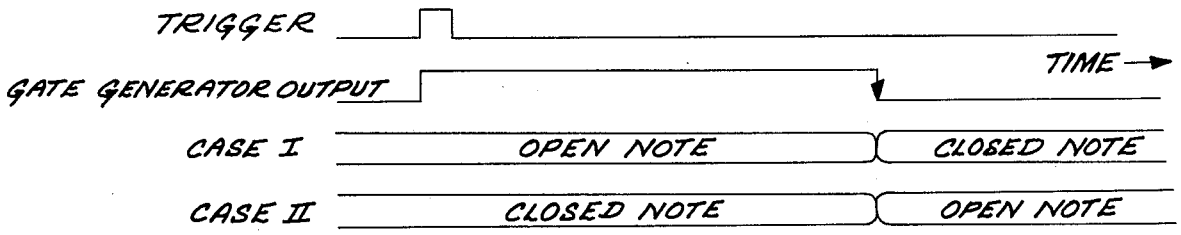
FIG. 11
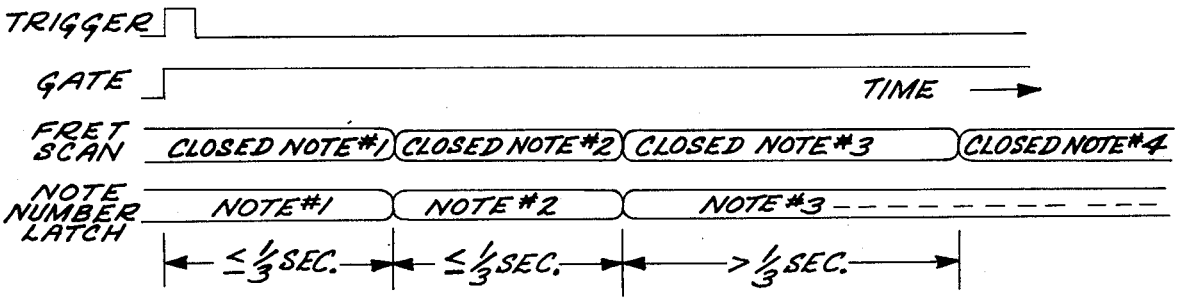

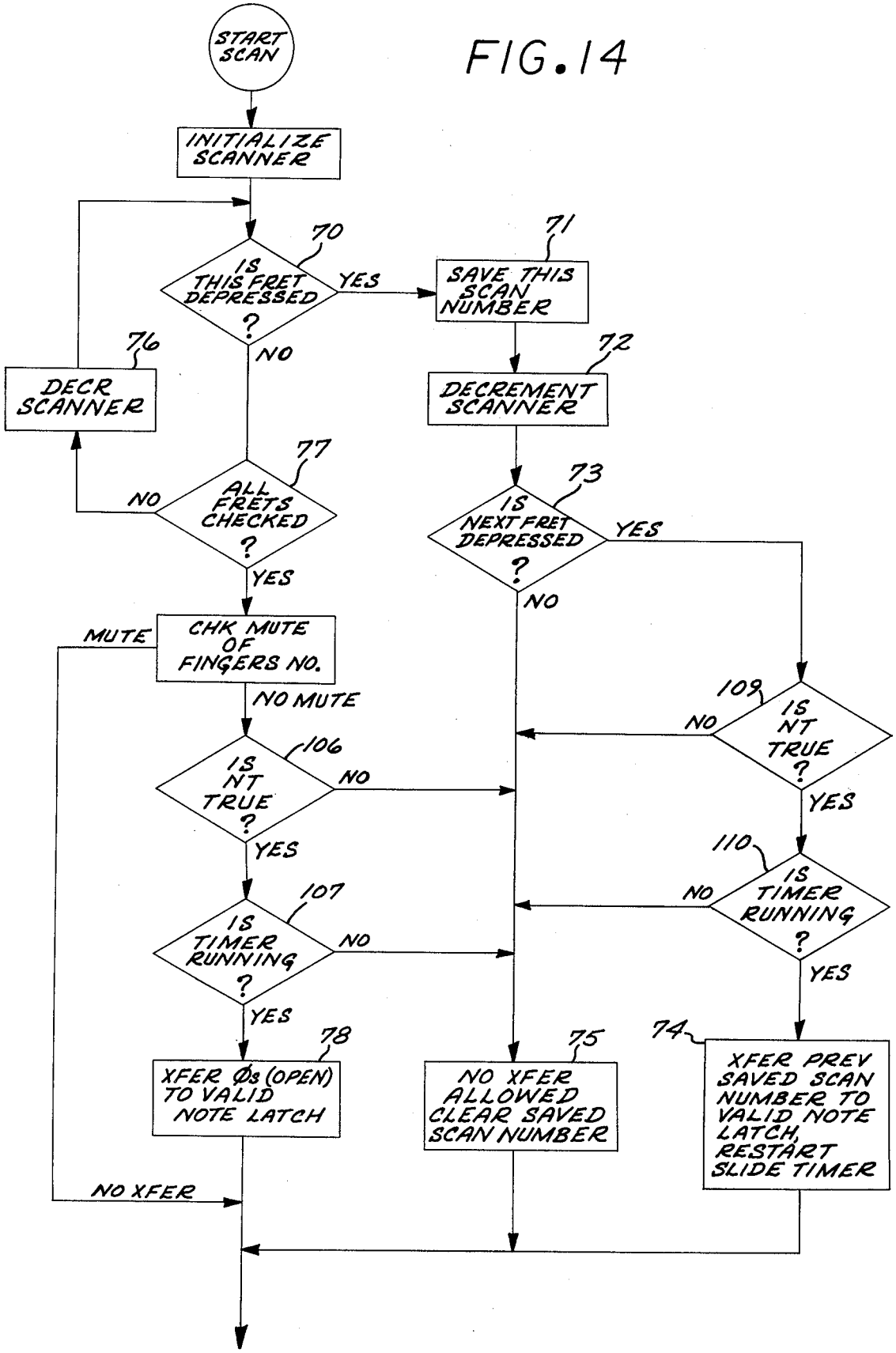
FIG. 14
START SCAN
INITIALIZE SCANNER
70
IS THIS FRET DEPRESSED ?
YES
NO
71
SAVE THIS SCAN NUMBER
72
DECREMENT SCANNER
76
DECR SCANNER
77
ALL FRETS CHECKED ?
NO
YES
73
IS NEXT FRET DEPRESSED ?
YES
NO
MUTE
CHK MUTE OF FINGERS NO.
NO MUTE
106
IS NT TRUE ?
NO
YES
107
IS TIMER RUNNING ?
NO
YES
109
IS NT TRUE ?
NO
YES
110
IS TIMER RUNNING ?
NO
YES
78
XFER Ø's (OPEN) TO VALID NOTE LATCH
75
NO XFER ALLOWED CLEAR SAVED SCAN NUMBER
74
XFER PREV SAVED SCAN NUMBER TO VALID NOTE LATCH, RESTART SLIDE TIMER
NO XFER

STRINGED INSTRUMENT SYNTHESIZER APPARATUS

BACKGROUND OF THE INVENTION

This invention relates to musical instruments and more specifically to a unique method and apparatus for enabling operation of electronic music synthesizers by musicians accustomed to playing non-keyboard instruments such as guitars, banjos, etc.

For many years, musicians utilizing single instruments have been presented with electronic and/or electromechanical methods for controlling other instruments. For example, various methods for utilizing guitars to control electronic organs have been disclosed. Other methods for utilizing trumpet instrument fingerings to produce corresponding tones on electronic organs have also been disclosed.

With the advent of the electronic musical synthesizers, a tremendous range of new sounds has become available. The first musical controller utilized for the synthesizer was the standard piano-type keyboard which allowed pianists and organists access to the synthesizer. Several years later, guitarists were able to enter the realm of synthesizers with the introduction of guitar-to-synthesizer interfacing devices, sometimes referred to as guitar synthesizers.

The prior art guitar synthesizers are of two general types. One type provides the user with a specially constructed guitar with sensing elements in the neck to indicate tones being played. A second type provides a special electromagnetic pick-up for the musicians' own guitar to allow sensing of the strings vibrations which in turn are interrogated externally by additional circuitry to determine tones being played. In both cases, after the tone(s) are determined, conversions are implemented by electronic means to produce voltages and control signals that drive the electronic synthesizer to cause the production of corresponding tones.

Both of these prior art methods have severe shortcomings. With the specially constructed guitar, as provided in the prior art, musicians must either swap their own guitar for the synthesizer guitar each time they require the special synthesized sounds, or play only the special guitar. Since guitarists spend much time and money in selecting their own guitar, there is strong resistance to playing another guitar full time, even to acquire special voicings. The total inconvenience of switching guitars in mid-song should be apparent.

With the special electromagnetic pick-up method, the user can continue to use his own guitar and switch the special effects in or out as required. However, this method creates severe problems in the electronic extraction of the tone. The vibrating string is a complex sound generator and creates tremendous problems when trying to determine the one tone that is being played. This gives rise to poor reliability, high cost and extraneous sounds being produced unless the musician alters his playing technique drastically. Additionally, feed-through from one vibrating string to another does not allow polyphonic synthesizers (more than one note at a time) nor usage with hollow-body guitars. A hollow-body guitar by design has more resonance and thus more intense string vibrations than solid body guitars. Vibrations caused by the plucking of one string causes sympathetic vibrations of the remaining strings and may cause a situation where the tone extraction circuit cannot effectively operate in this highly interactive environment.

A third type of musician-to-synthesizer interface that has not found any commercial implementation but has appeared in some periodicals is mentioned here as a comparison. The interface is typically made in the form of a flat typewriter-type keyboard with rows and columns of keys. Playing the instrument is done by pressing one or more of the keys using typewriter techniques. Even if the keys are capacitive touch keys instead of mechanical action switches, this interface does not approximate a real instrument of any kind and is useful only as an experimental device for musicians not accustomed to either keyboards or guitars.

From the above description it can be seen that all existing guitar-synthesizer interfaces suffer from one or more deficiencies; the most prevalent being:

(1) causing the guitarist to modify his normal playing technique by requiring extra care in plucking or fretting;

(2) eliminating several normal guitar characteristics such as sustain, open notes, chord capabilities or hammer; and (3) causing the guitarist to totally give up his own guitar for a specially modified device.

SUMMARY OF THE INVENTION

It is in general an object of this invention to provide an improved stringed instrument-synthesizer interface.

It is another object of this invention to provide a control mechanism for electronic musical synthesizers and the like which can be manipulated in a manner familiar to musicians of stringed instruments such as guitars, banjos, etc. or other non-keyboard instruments.

It is a further object of this invention to provide a device allowing the non-keyboard musician access to electronic music synthesizers while allowing him full use of his own instrument during non-synthesized passages.

It is another object of the invention to achieve highly reliable tone conversion without any change in playing techniques.

It is yet another object of the invention to provide a non-keyboard synthesizer interface apparatus which can be polyphonic and compatible with guitar, banjo, and mandolin techniques.

These and other objects and advantages are achieved according to the invention in conjunction with a fret-bearing surface having at least one string stretched thereover. Electronic means associated with the fret-bearing surface is designed to provide accurate generation of volume, gate and frequency control signals for an electronic synthesizer. Novel aspects include means for accurately detecting string depression, means for detecting slide and/or hammer movements, means for detecting open/close string status and means for properly responding to muting of strings, as well as combination of these various means into a cooperating whole. In a preferred embodiment, a micro-processor is used to time-share a plurality of strings to provide any or all of the above novel means. Novel means are also provided for minimizing and simplifying the multiplexing of the electrical interface with the fret-bearing surface. Another novel aspect of the invention is that the resulting synthesizer interface device may be attached to the musician's own instrument, thus allowing him access both to the synthesizer, as well as his own instrument.

The invention is more fully pointed out in the appended claims.

BRIEF DESCRIPTION OF THE DRAWINGS

The preferred embodiments and best mode presently contemplated for practicing the just summarized invention will now be described in detail in conjunction with the drawings of which:

FIG. 9 is a schematic circuit diagram illustrating an open/close detector according to the preferred embodiments.

FIG. 10 is a timing/waveform diagram illustrating the open/close detector operation.

FIG. 11 is a timing/waveform diagram illustrating slide timer operation.

FIG. 14 is a flow chart more particulary illustrating the frequency control signal production portion of the micro-processor operation of FIG. 13.

DETAILED DESCRIPTION OF THE PREFERRED EMBODIMENTS OF THE INVENTION

Figure 1:
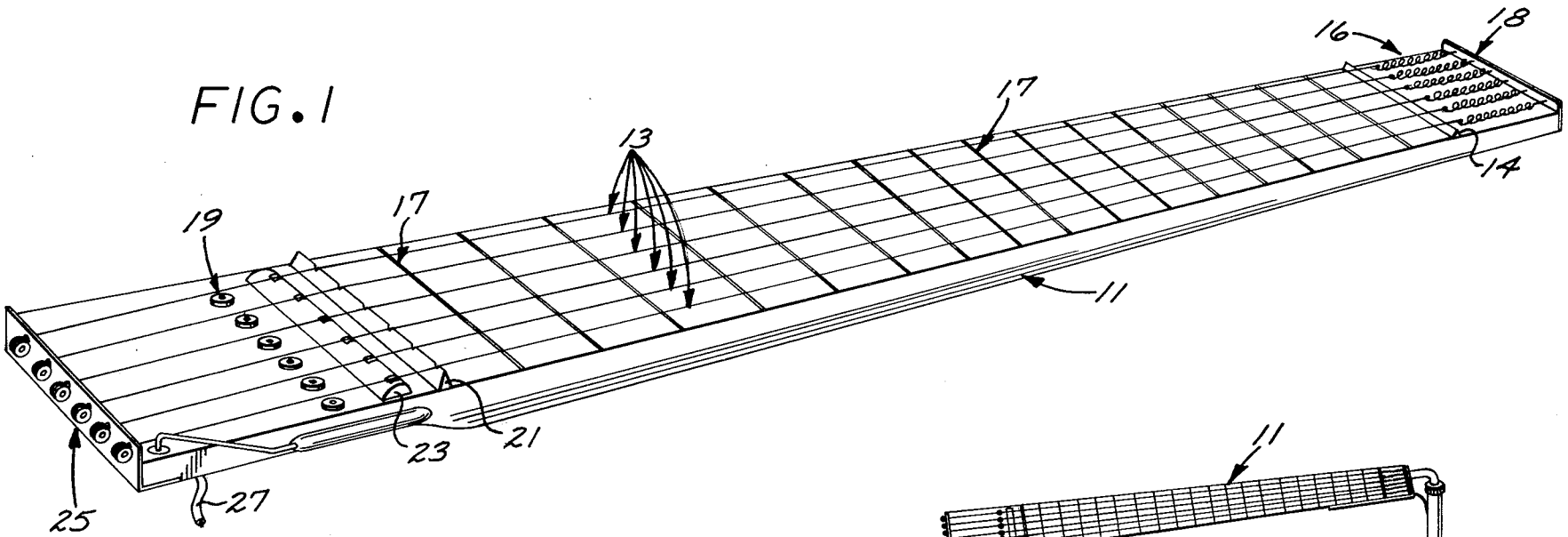
FIG. 1 is a perspective view illustrating a stringed, fret-bearing surface according to the preferred embodiments of the invention.
Figure 2B:
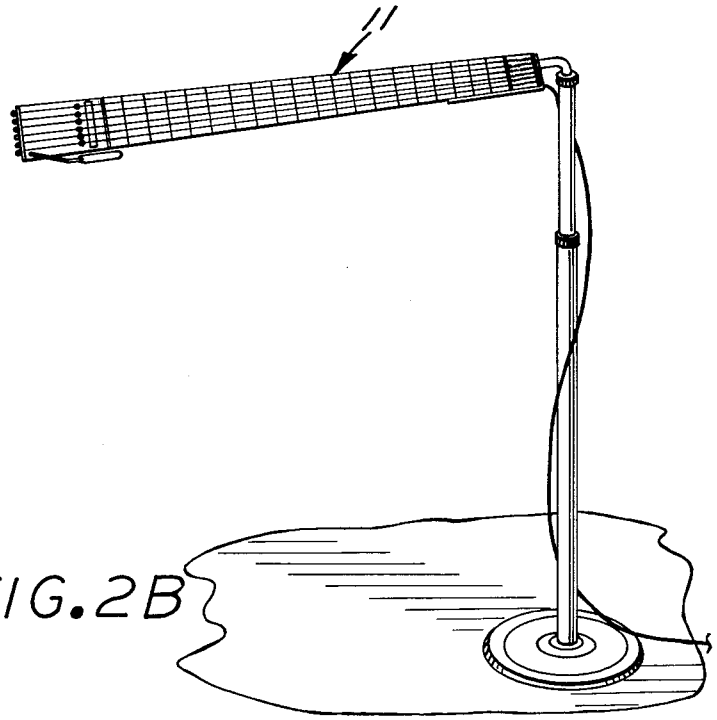
FIGS. 2A and 2B illustrate mounting of the apparatus of FIG. 1 in conjunction with a typical guitar or microphone stand.
Figure 2A:
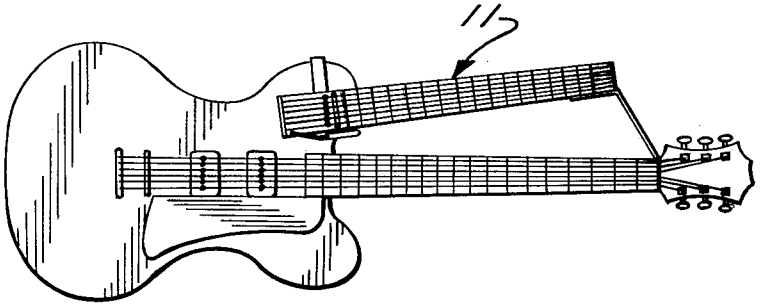

FIG. 1 illustrates a guitar parallel fret board or "neck" 11 according to the preferred embodiments. FIGS. 2A and 2B illustrate mounting techniques which provide mounting to an ordinary guitar (FIG. 2A) or to a microphone stand (FIG. 2B).

The fret board 11 has six strings 13 stretched across a neck-like structure somewhat shorter than the neck of a normal electric guitar. The strings 13 are not used for vibrational tone production, but for touching and therefore grounding certain switching elements embedded within or upon the keyboard surface. There are fifteen frets 17. Each fret 17 is composed of electrically conductive material divided into six segments, one fret segment for each string. The six conductive segments of each fret are electrically insulated from each other. Beneath the keyboard surface, certain frets 17 are wired together for electronic minimization of certain multiplexing hardware as discussed hereafter. While conductive fret segments are utilized to detect string depression in the preferred embodiment, many other switching means may be used without departing from the scope of the invention.

The six strings are stretched for a short distance past the last fret 17 and pass over six electromagnetic sensors 19. These additional lengths of the strings 13 are bridged by a rear bridge 21, and the strings are heavily muted from beneath with firm foam material 23. The strings are attached at a rear mounting bracket 25. The short string segments between the rear bridge 21 and the rear mounting bracket 25, are used for plucking. When a string is plucked, the electromagnetic pick-up 19 generates a short pulse train (20 milliseconds) with amplitude proportional to the intensity of the pluck. The peak-detected version of this pulse train is to be used to control the volume of the generated note thereby giving control of dynamics to the player. The foam muting material 23 prevents interaction between fast plucks since even the fastest plucks are typically separated by 50 milliseconds or more.

A sheathed cable 27 exits from one end of the neck, carrying various control signals to external electronic circuitry as required. These external circuits perform operations based on inputs from the parallel keyboard 11 and in turn generate control signals for the synthesizer such that the synthesizer will play the notes as played by the musician on the parallel keyboard. These circuits will now be described in more detail in conjunction with FIG. 3.

Figure 3:
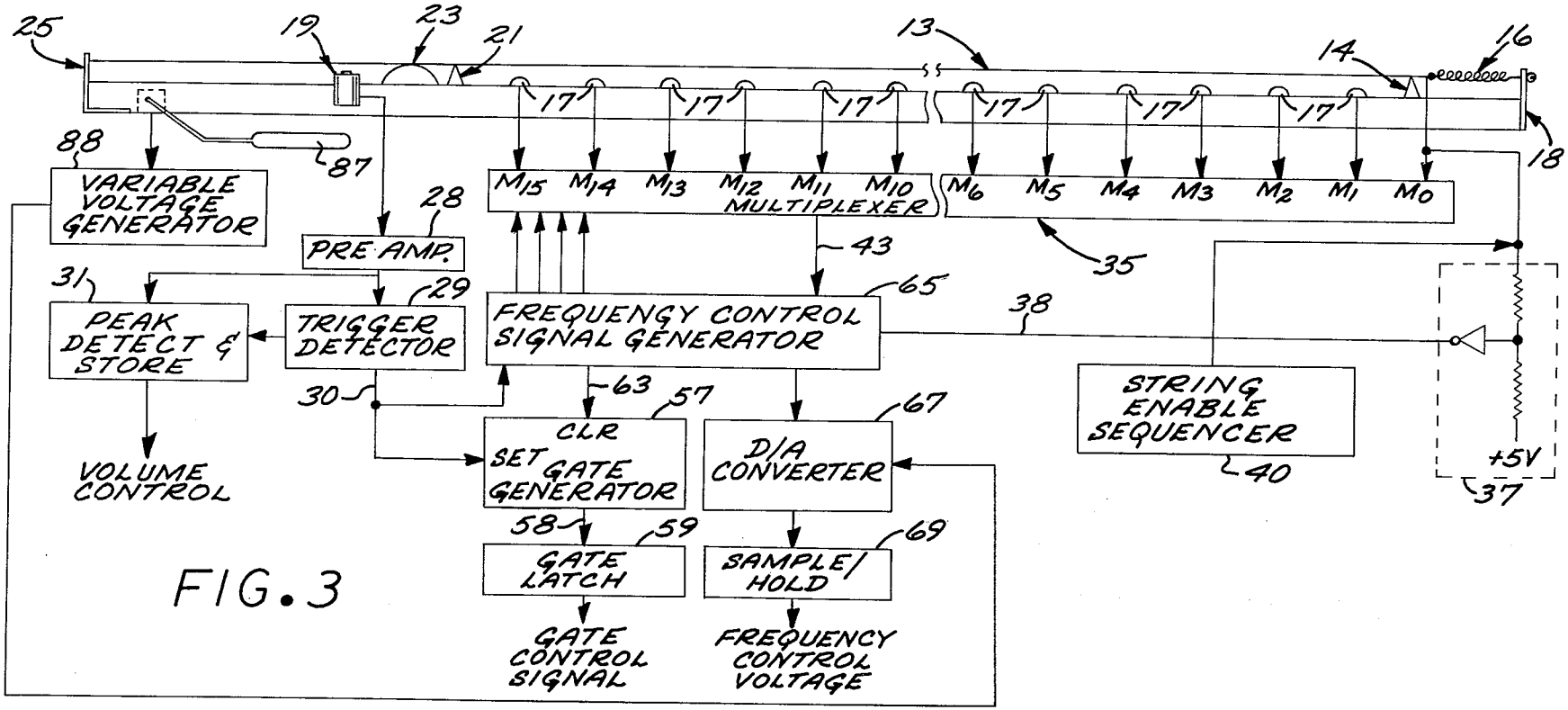
FIG. 3 is a circuit schematic diagram illustrating an implementation of the preferred embodiments.

FIG. 3 shows a system for operation with one string. A description of the structure and operation of the system will now be given to explain how the system performs much like a normal instrument. To facilitate discussion, explanation will be given initially for only one string, with the extension of the technique to six strings illustrated thereafter.

The purpose of the overall system in FIG. 3 is to define to a synthesizer (1) what note to play by producing a frequency control voltage (2) when to play that note by producing a gate output, and (3) how loud to play the note by producing a trigger amplitude signal.

The frequency control voltage is generated by a frequency control signal generator 65. The digital frequency control signal is converted to analog form by a digital to analog (D/A) converter 67, and supplied to the synthesizer by a sample/hold circuit 69. The frequency control voltage represents the note selected on the keyboard 11 by the musician.

The gate control signal is provided by a gate latch 59 which holds the gate control information provided by a gate generator 57. The operation of the gate generator 57 is controlled by two control signals, the trigger strobe on a line 30 and a clear gate control signal on a line 63. Upon setting of the gate generator 57 by the trigger strobe signal, the output of the gate generator 57 on line 58 makes a transition from zero to a positive voltage, causing an envelope volume increase in the synthesizer output. When the clear-gate signal is sent over line 63, the gate control signal drops to zero and decay of the envelope of the synthesizer output commences.

The volume control signal is provided by the output of a peak detect and hold circuit 31. This signal causes the synthesizer to modify its volume in direct proportion to the amplitude of the peak stored by the peak detect and hold circuit 31.

Figure 4:
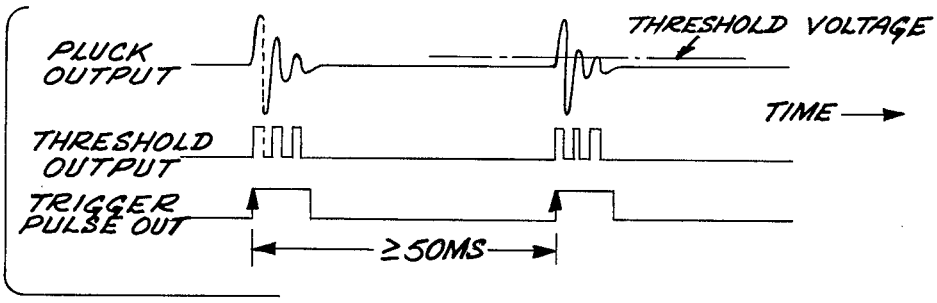
FIG. 4 is a waveform diagram illustrating trigger pulse production from a string pluck.

In FIG. 3, plucking of the string 13 initiates all tone production by setting the gate generator 57. Each time the string 13 is plucked, a trigger pulse signal is generated by the electromagnetic pick-up 19 directly beneath the string 13. This trigger pulse signal is amplified by a pre-amp 28 and fed to a trigger detector 29. The trigger detector 29 converts the trigger pulse signal to a trigger strobe signal of voltage level suitable for driving other elements of the control circuitry. This is done according to the well-known technique of passing the plucked output through a threshold comparator to generate a TTL logic level and supplying this TTL logic level to a retriggerable one-shot to generate a single pulse for each pluck. The resulting waveforms are shown in FIG. 4. The trigger strobe appears on a line 30.

Figure 5:
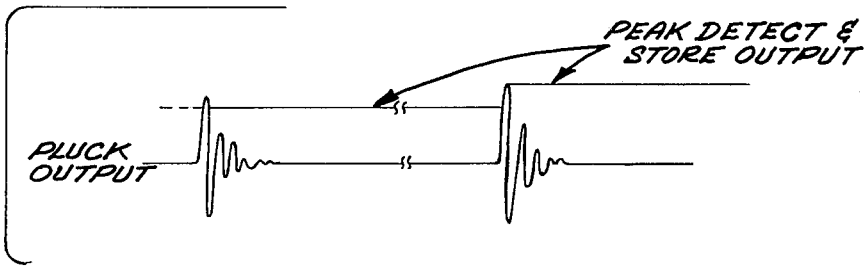
FIG. 5 is a waveform diagram illustrating peak detection of the output resulting from a string pluck.

Additionally, the preamplified trigger pulse is peak detected and sample held by the peak detect and hold circuit 31 to provide an amplitude signal for driving the synthesizer's volume control. The resultant waveforms are illustrated in FIG. 5. In this manner, the synthesizer output becomes a direct function of the intensity of the plucking.

To faciliate detection of the particular note selected by the musician, the string 13 is selectively subjected to zero volts (grounded). When grounded, the string 13 is enabled to apply zero volts to each fret segment it touches when the string 13 is pushed down at any of the one of the fifteen fret positions.

The frets 17 are individually connected to the inputs, $M_1$ through $M_{15}$, of a 16:1 multiplexer 35. The string 13 itself is connected to the right most multiplexer input $M_0$ such that with no depressed frets, an "open string" indication will be given.

Figure 6:
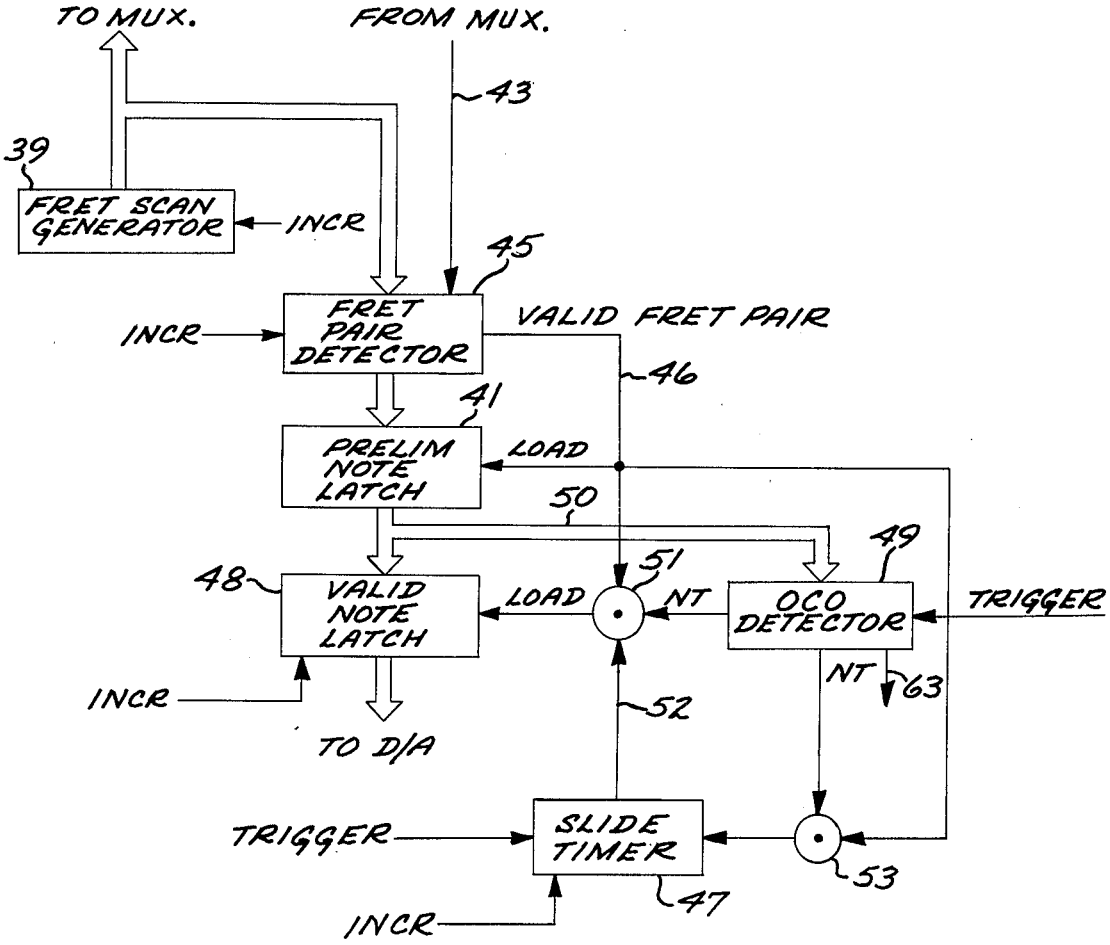
FIG. 6 is a schematic block diagram illustrating the frequency control signal production technique of the preferred embodiments.

The frequency control signal generator is shown in more detail in FIG. 6. In FIG. 6, generation of the proper frequency control signal is performed by the cooperation of a fret scan generator 39, a preliminary note latch 41, a valid note latch 48, a fret pair detector 45, a slide timer 47 and an open-close-open (OCO) detector 49. Two AND gates 51, 53 also participate in this operation.

The fret scan generator 39 provides a select code to the multiplexer 35 and to the fret pair detector 45. This code represents the fret being examined at successive time intervals. Movement from fret to fret is caused by a system clock called INCR (increment).

The fret pair detector 45 indicates a note has been selected by the fingerboard player and provides a valid fret pair control signal to other circuits. The valid note latch 48 latches the note actually to be provided to the synthesizer and supplies it to the D/A converter 67.

The multiplexer circuit 35 (FIG. 2) is a slave to the control circuitry of FIG. 6 and may be a Texas Instrument 74150 16:1 multiplexer. Four bits of select code are then sent from the fret scan generator 39 in the controller to the multiplexer 35. These four bits indicate in binary format which of the sixteen multiplexer inputs $M_0 \ldots M_{15}$ is to be observed. The multiplexer inputs are successively scanned from left to right $M_{15}$, $M_{14}$, $M_{13}$, . . . $M_0$. In response to the select code, the multiplexer 35 generates a logic "1" output if the fret segment identified by the select code has a string depressed against it or a logic "0" output if it does not. These outputs are provided over a connection 43 to the fret pair detector 45.

From this feed back on line 43, the fret-pair detector 45 ascertains whether two adjacent frets are depressed or only one. The inventor has found that detection of two adjacent frets being depressed reliably indicates a note selection by the musician, whereas detection of only one fret being depressed indicates a change in note selection such as release of the current note or a slide to a new note.

In the circuit of FIG. 6, fret pair detection can be accomplished by monitoring the multiplexer output 43. Upon detection of a first logic "1", the select code of the fret scan generator 39 is latched by the fret pair detector 45. If a second logic "1" is detected by the fret pair detect logic 45 upon provision of the next successive fret scan generator output to the multiplexer 35, the fret pair logic 45 produces the valid fret pair signal on line 46. This signal causes the code latched by the fret pair detector 45 to be transferred to the preliminary note latch 41. If, on the other hand, the next successive fret scan generator output results in a zero at the multiplexer output 43, no transfer is made to the preliminary note latch and, preferably, no further scanning of the string is allowed. If all sixteen frets 17 are scanned by the fret scan generator 39 without detection of a valid note or a single closed fret, transfer of an all-zero indication (an open string) to the valid note latch 48 occurs.

Figure 7:
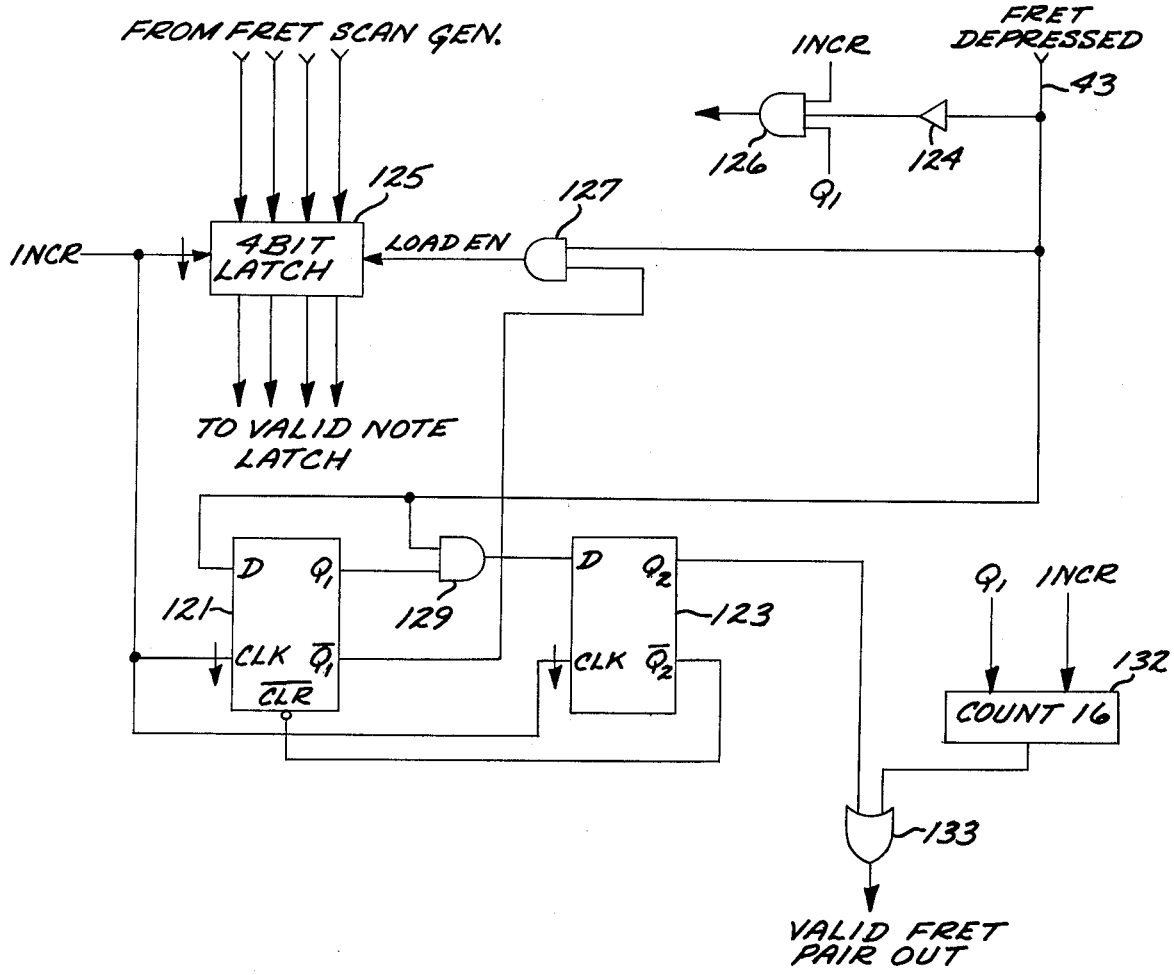
FIG. 7 is a schematic circuit diagram illustrating the fret pair detection technique of the preferred embodiments.
Figure 8:
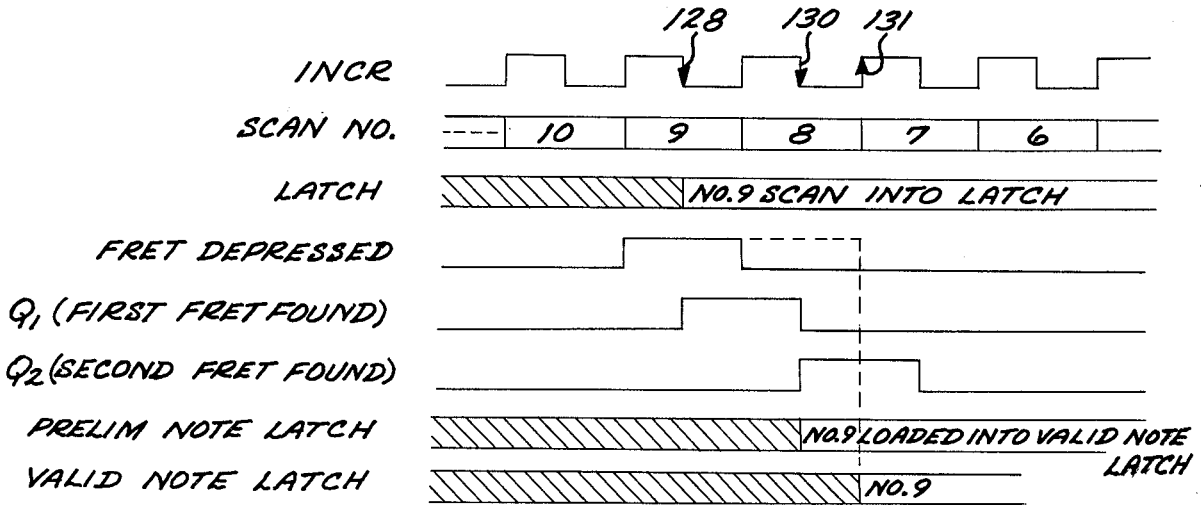
FIG. 8 is a timing diagram further illustrating the fret pair detector operation according to the preferred embodiments.

FIGS. 7 and 8 illustrate hardware and timing for the fret pair detector 45. The hardware includes first and second fret flip-flops 121, 123, a four-bit latch 125 and two AND gates 127, 129. The latch 125 and flip-flops 121, 123 are supplied with the system clock INCR, illustrated in the first line of FIG. 8. Initially, the first and second fret flip-flops 121, 123 are cleared. Scanning begins at fifteen and progresses to zero. Scanning is stopped at zero and re-started or will be stopped when a valid fret pair is found.

When a fret is first found depressed, the first AND gate 127 is partially enabled by the "fret depressed" signal on line 43. As shown by the "scan number" in FIG. 7, the first fret found depressed in this illustration is fret number nine. Since the first fret flip-flop 121 is clear, the $Q_1$ input to the AND gate 127 is high causing production of the "load EN" signal to the four-bit latch 125. The INCR signal going negative 128 then loads the scan number representing fret nine into the four-bit latch 125. This same edge 128 sets the first fret flip-flop 121, causing $Q_1$ to disable the first AND gate 127 from allowing any further loading of the latch 125.

If the next fret, number eight in FIG. 8, is not depressed then the next fall of INCR 130 will clear the first fret flip-flop 121. Scanning may be terminated by production of a "cease scan" signal produced at the output of an AND gate 126. The inputs to this AND gate 126 are the inverted form of the signal on line 43 supplied by an inverter 124, the INCR signal and the output $Q_1$ of the first flip-flop 121.

If the next fret number eight is depressed, then the next fall 130 of the clock INCR will set the second fret flip-flop 123 via the AND gate 129 and clear the first fret flip-flop 121. The second fret flip-flop output $Q_2$ becomes the valid fret pair signal at the output of an OR gate 133. This signal allows loading of the preliminary note latch 41 with the previously held scan number (number nine).

If other conditions discussed hereafter are valid, this number (nine in the example) can be transferred to the valie note latch 48. The valid note latch 48 is loaded when enabled by the "INCR" waveform but on the positive going edge 131 of the clock INCR, which allows all decisions to settle prior to loading the valid note latch 48.

If sixteen frets 17 are scanned without detecting an output on line 43, a count sixteen circuit 132 produces the valid fret pair signal. This counter circuit is incremented by the clock INCR and is reset by $Q_1$ or upon reaching the count of sixteen. This signal produced by the count circuit 132 enables loading of an all zero pattern indicating an open string.

As noted above, the contents latched by the fret pair detector 45 are supplied to the preliminary note latch 41 upon production of the valid fret pair signal. Before the note can be latched by the valid note latch 48 as a valid note for presentation to the A/D converter, two further conditions must be met at the AND gate 51.

The first condition is that the slide timer 47 is still running, as indicated by the timer running signal supplied to the AND gate 51 by the slide timer 47. The second condition is that a change from open to closed or closed to open has not been detected, as indicated by the input to the AND gate 51 from the OCO detector 49. Hence, the valid note latch 48 is prevented from being updated if the slide timer 47 has timed-out or the OCO detector 49 has detected a change in the open-closed condition of the string 13. The operation of the slide timer 47 and OCO detector 49 will be described in further detail below.

The OCO detector 49 is one of three method used to determine when to lower the gate to the synthesizer. It stores the state of the string (open or closed) when a pluck occurs and allows the gate to the synthesizer to remain on until the opposite state occurs. If a player plucks an open string, then the open note will sustain until the player depresses that string or bridges it via his finger to an adjacent string. If a pluck occurs with the string depressed onto a fret, the note will sustain until the string is released.

A circuit embodiment illustrating the structure of an OCO detector 49 is shown in FIG. 9. This circuit includes an open/closed (OC) flip-flop 80 and a gate flip-flop 81, as well as an exclusive-or (EX-OR) gate 82 and a NAND-gate 83. The NAND-gate 83 is supplied with the signals on line 50 from the preliminary note latch 41. The output of the NAND-gate 83 indicates a "1" if the note represented by the contents of the preliminary note latch 41 is an open note (all zeroes) and a "0" if that note is closed. The output of the NAND-gate 83 is supplied to the "D" input of the D-type OC flip-flop 80. The clock input 84 of the OC flip-flop 80 is supplied with the trigger pulse on line 30. The Q output and the "D" input of the OC flip-flop 80 form the inputs to the EX-OR gate 82. The trigger signal, the output of the EX-OR gate 82, and the touch indicator signal on line 38 (FIG. 3) provide the inputs to the gate flip-flop 81, which is illustrated as a pair of cross-coupled NOR gates.

The operation of this circuit may be described as follows: Each time a trigger occurs, the OC flip-flop 80 is updated—its Q output going to zero if all zeroes are present at the inputs to the NAND gate 83 or going to "1" if there is at least one "1" present at the input to the NAND gate 83. The trigger also sets the gate flip-flop 81. The inputs of the EX-OR gate 82 match (11 or 00) and hence its output goes to zero, releasing any clear to the gate flip-flop 81. If, following the trigger on line 30, the preliminary note latch 41 supplied a second note code which represents a change from open to closed or closed to open, then the inputs to EX-OR 82 will be different (10 or 01), thereby producing a "1" output which causes the output 63 of the gate flip-flop 81 to go to a zero thereby dropping the gate. The output of the EX-OR gate 82 is also inverted by an inverter 86 to provide a signal "NT" which will prevent the valid note latch 48 from latching the note representing a change in open/closed condition. "NT" indicates that an open to close or close to open transition has not occurred due to any valid note updates.

FIG. 10 presents waveforms illustrating the overall operation of the OCO detector 49 for two cases. Case I shows an open note present when the trigger occurs, setting the gate generator 57. Thereafter, the open note going to a closed note clears the gate generator 57. Case II shows initial selection of a closed note at the time the trigger on line 30 sets the gate generator 57. Thereafter, the occurrence of an open note clears the gate generator 57. The valid note latch 48 retains the original note.

The slide timer 47 is configured of conventional digital counter circuitry. Each time a trigger pulse is generated on line 30, the slide timer 47 is started. If the timer 47 reaches its maximum count of approximately $\frac{1}{3}$ second before any new notes are made available to the valid note detector, the timer will disable itself and disallow any further latching of new notes. If, however, a new valid note is detected by the fret pair detector 45 and supplied by the preliminary note latch 46, for example, as a result of a slide or a hammer, the timer 47 is started again, provided the new note does not represent a change from open to closed or closed to open. As long as new valid notes are supplied by the preliminary note latch 41 within each $\frac{1}{3}$ second window, the repeat can continue indefinitely. As soon as a pause of greater than $\frac{1}{3}$ second is encountered, only a trigger pulse will again start the slide timer 47 running. The slide timer 47 is reset by the output of the AND gate 53 whose two inputs are the signal NT from the OCO detector 49 and the valid fret pair signal from line 46.

The waveforms of FIG. 11, illustrate the operation of the slide timer 47. When a trigger occurs on line 30, a closed note is present and the timer running signal (line 52, FIG. 6) and gate signal (line 58, FIG. 3) start. After a first interval of less than $\frac{1}{3}$ second, a new valid note (closed note #2) is found to have been selected and that note's number is permitted to be transferred to the valid note latch 48 by coincidence of the timer-running signal and NT signal. A second new note (closed note #3) is detected within the next $\frac{1}{3}$ second interval, and it is also latched by the valid note latch 48. However, the third new note (closed note #4) occurs after the timer 47 has run-out and the timer-running signal is not present. Hence, the third new note cannot be latched by the valid note latch 48.

The slide timer operation just-described allows the musician to move to a new hand position on the fret board 11 following a note without having the synthesizer play the note before a trigger, yet gives slide and hammer capability to the instrument only if the movement occurs within $\frac{1}{3}$ second of a pluck. A typical "slide" is a movement of the finger along a depressed string made in such a way as to cause progressive changes in frets being touched. More musically it could be interpreted as glicendo with discrete frequency points during movement. An example of a hammer-on is the rapid movement of a finger down between two frets to cause a new note to be sounded without a second pluck after a first note has been initiated by plucking. An example of a hammer-off is the rapid release of a fretted position to a new fretted position without a second pluck. Hammer-ons and offs may be alternated rapidly after a single initiating pluck for "trill" effects. Such movements are part of the technique and artistry of the fret-board player and can be expected to vary.

The above discussion illustrates the basic techniques of applicant's invention. These techniques may be readily extended to a keyboard having six strings by use of several sets of circuitry or, more efficiently, by use of a micro-processor As is well-known, a micro-processor contains circuitry such as latches, timers, flip-flops and logic functions which can be readily programmed to incorporate the basic techniques already taught herein. That is, the latches used can be replaced by memory locations, the flip-flops can be storage bits (so called flags) and sequential operations can be replaced by coded instructions such as ADD, SHIFT, COMPARE, etc. The conversion of such hardware is readily apparent to those skilled in the art of micro-processor programming and implementation aided by this disclosure.

Figures 12, 12A:
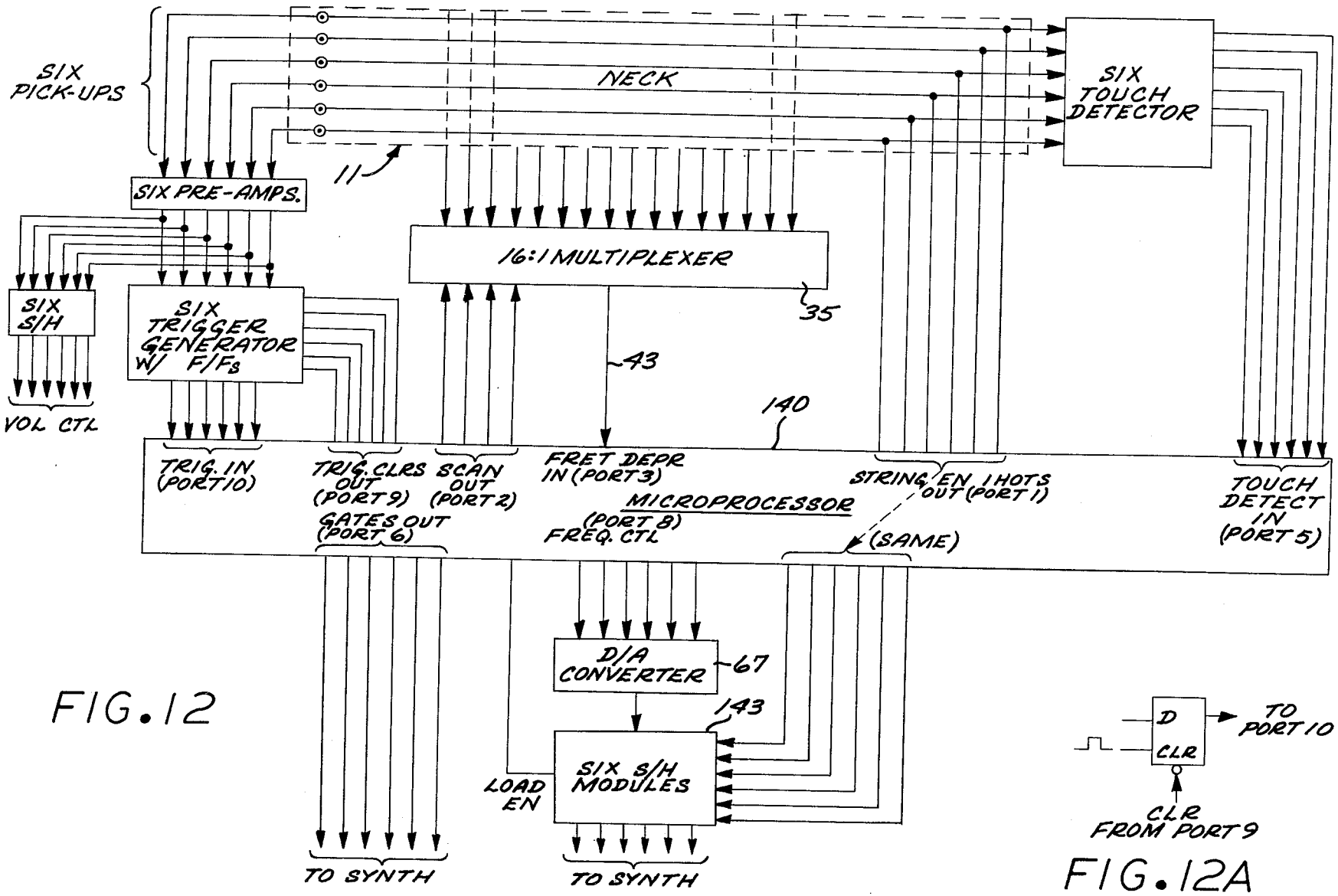
FIG. 12 is a schematic block diagram illustrating an embodiment of the invention employing a microprocessor.
FIG. 12A illustrates a trigger pulse detector particularly useful in the embodiment of FIG. 12.

FIG. 12 illustrates a six-string system utilizing a micro-processor 141 for replacing or sharing most of the hardware of FIG. 2. The micro-processor 140 used can be one of several available single chip micro-processors such as the INTEL 8048 with port expanders to increase the number of input and output lines available. The processor 140 has internal storage locations and a software controlled timer. Such a processor typically has available "tri-state" ports which, in addition to providing logic "1" and "0" outputs, also may provide a third high impedance state of several megaohms. In the preferred micro-processor embodiment, the string enable outputs, Port 1, are such tri-state ports.

FIG. 12 shows the multiplexer 35 and the D/A converter 67 being shared by the processor 140, the remaining frequency determining hardware 65 of FIG. 3 having been incorporated into the processor. The other labeled blocks of FIG. 12 are duplications times six of the corresponding circuitry from FIG. 3 and operate as previously described. For micro-processor implementation, it is advantageous to use the leading edge of the trigger "pulse out" (FIG. 4) to set a "D" flip-flop which is then cleared by the processor 140 when it reads the trigger status into the port. This avoids erroneous readings on elongated pulses. This device is illustrated in FIG. 12A.

A clarifying description of the timing sequence is now provided in connection with FIG. 12 to indicate generic operation of the micro-processor interface. Each string is handled by the micro-processor 140 in sequential fashion from 1–6, then 1–6 etc. Each string is given exactly 1/6 of the allocated sequence time (assume 2 ms) for its service routine. That is, the longest series of coded instructions necessary to perform the longest operation must be less than 1/6 of the total. Otherwise, all service routines must be elongated and the total elongated.

If a service routine is shorter than this maximum, a wait state is entered to fill the time before progressing to the next string. This allows time measurements to be performed by each service routine since each entry to a service routine is exactly 2 ms later than the previous entry. For example, to do the slide timer operation, one can start with a storage location set to zero when a trigger occurs for string "n" and increment the location by 2 ms. each time that string is serviced. After 166 entries we have accumulated 332 ms. which is $\frac{1}{3}$ second as required. If a new valid note is received during that $\frac{1}{3}$ second (which is a condition previously described to re-start the timer) the micro-processor 140 can reset the timer location of string "n" to zero and continue counting.

The sharing of the D/A converter 67 by all strings is done by connecting six sample/hold modules 143 to the single output of the D/A converter 67 and selecting the appropriate module based on the string selected at the time. To avoid slow discharge of the sample/hold capacitors within the modules, the sample/hold module 143 is refreshed at least once during each 2 ms. scan time.

The sharing of the 16:1 multiplexer 35 is straightforward. Port 2 of the micro-processor 141 is sequenced to produce the scan inputs to the multiplexer 35 as previously described, but only one of the six strings has ground applied to it via Port 1 so the resultant fret depressed output 43 corresponds only to the string being observed at that time.

Figure 13:
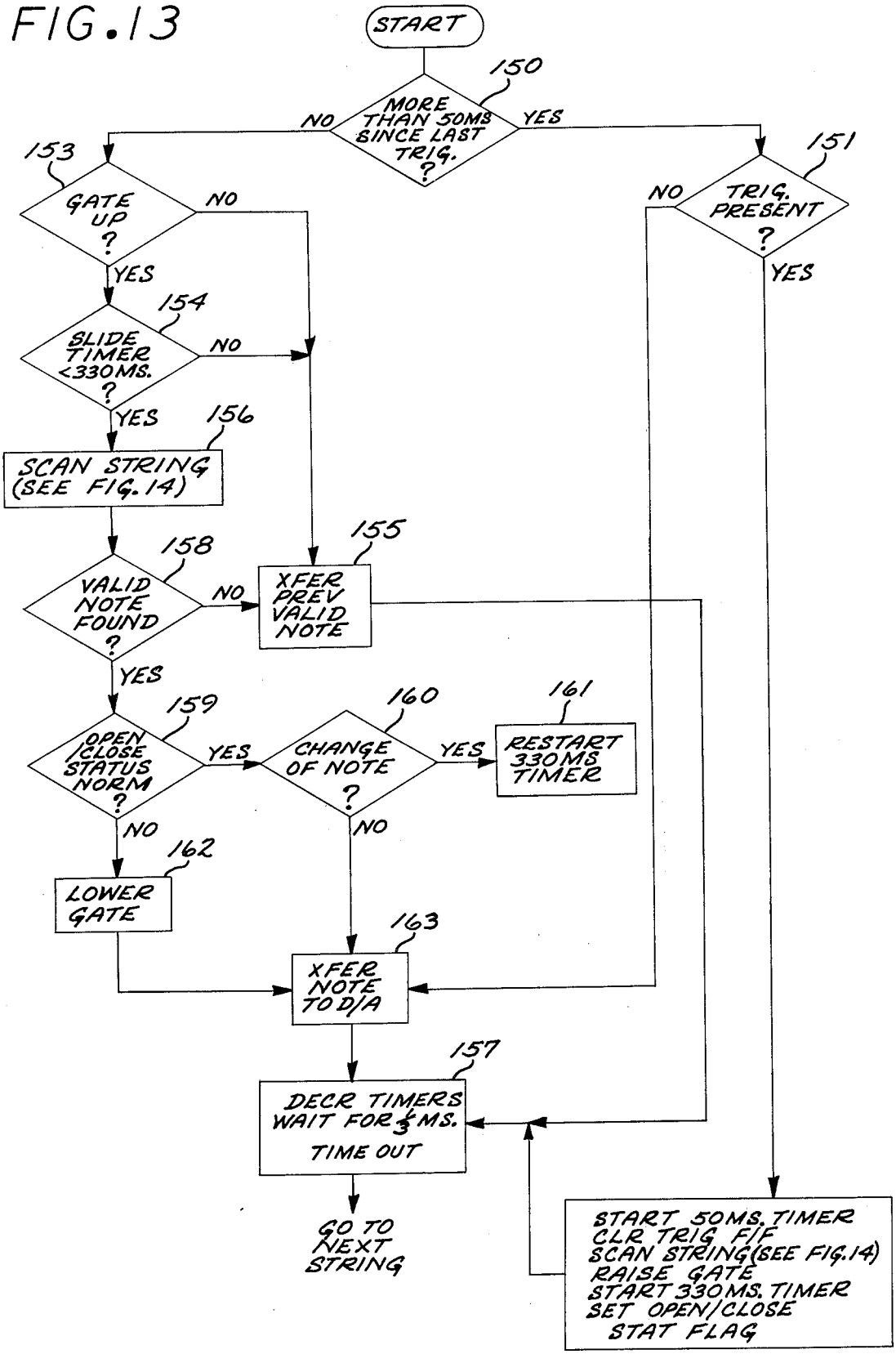
FIG. 13 is a flow chart illustrating operation of the micro-processor of FIG. 12.

Referring to FIG. 13, upon power up ("start" FIG. 13), all gates are inactive on Port 6, the Port 1 outputs are set to give string 1 a zero and all other strings a tri-state condition, and all trigger flip-flops have been cleared.

Assuming it has been more than 50 ms. since the last trigger, test 150 is satisfied and the micro-processor then reads Port 10 to see if string 1 has produced a trigger. If no trigger is present, test 151 is negative, and no action is taken on that particular string except to transfer the previous valid note to the D/A converter 67. When, on subsequent scans, a trigger is observed and test 151 is satisfied, a timer is started to prevent looking at the trigger again for at least 50 ms. This prevents "chatter" from occurring by multiple looks at the same trigger. The program then issues a clear to the string 1 trigger flip-flop via a Port 9 bit.

In response to the trigger detected in test 151, the program also scans the keyboard and determines what note is being played and sets a flag bit indicating whether the note is open or closed. On subsequent keyboard scans, the OC status is compared to allow lowering the gate if the opposite state occurs.

Having found a valid note, the program outputs the note to the D/A converter 67 and issues a load EN (load enable) the the Sample/Hold module associated with string 1, causing storage of a voltage corresponding to the note being played.

The trigger also starts the slide timer to allow 330 ms to look for a valid change in the note. Each time the program finds a valid different note that is not a status change note (open to close, or close to open), the note is transferred and the timer restarted. The trigger also starts the previously mentioned 50 ms. timer which disallows further triggers from being observed.

If the test 150 is not satisfied, that is, if more than 50 ms. have not elapsed since the last trigger, the program flow branches to the left to a test 153 which examines the gate status. If the gate is not up, the flow proceeds from test 153 to blocks 155 and 157. The operations performed are to transfer the previous valid note from a processor storage location to the sample hold for refresh, and to then appropriately decrement the various timers, time-out and proceed to "start" for the next string.

If, at test 153, it is determined that the gate is up, another test 154 is peformed to ascertain whether the slide timer has timed out. If it has, the flow proceeds to block 155. If the slide timer has not timed out, a scan of the string for new valid notes is performed.

If a valid note is found, test 158, and the open/close status has not changed, test 159, the flow proceeds to test 160 where it is determined whether the valid note is a new note. If test 160 is satisfied, the slide timer is restarted, block 161, and the note is transferred to the D/A converter, block 163. If test 160 determines there has been no change of note, the previously valid note is transferred to the D/A converter, block 163.

If test 159 determines there has been a change in the open/close status of the string, the gate is lowered, block 162, and the previously valid note is transferred to the D/A converter, block 163.

The frequency control signal production portion of the string scan of FIG. 13 is illustrated further in the flow diagram of FIG. 14. The fret segments 17 are scanned from left to right by the scan generator. When the string 13 is found depressed upon a fret 17, test 70, the scan (fret) number is saved, block 71. The scanner is then decremented by one, block 72, and one additional multiplexer input is examined, block 73, to determine the status of the next fret. If the string 13 is also depressed against the next fret 17, then the scan number saved in block 71 is supplied to the OCO detector 49. Assuming tests 109, 110 are satisfied (i.e. NT is true and the slide timer is still running), the saved scan number is transferred to the valid note latch 48. If any of the tests 73, 109, 110 are not satisfied, no transfer to the valid note latch 48 is permitted, the saved scan number is cleared, block 75, and the routine goes to the next step, test 158 or "raise gate" in FIG. 13.

If, in block 70, FIG. 14, the string interrogated is not depressed against the fret examined, a test 77 is made to ascertain whether all frets have been checked. If the test 77 shows all frets have not been checked, the scanner is decremented, and the flow returns to block 70 to examine the next fret. If all frets have been checked, the mute status of the string is examined, block 105. If the string is muted, no transfer of a new note is performed. If the string is not muted, the fret proceeds to a test 106. Assuming NT is true and that timer running signal is present, tests 106 and 107 are satisfied, and the open note indication (all zeroes) is supplied to the valid note latch 51. If after block 105, either test 106, 107 is not satisfied, the routine proceeds to block 75.

When the string 13 is in the high impedance state and therefore not being used for fret indications, a special touch detect circuit 37 may be used to detect when the player's fingers are touching the string 13 without depressing the string 13 to the extent necessary to contact a fret 17. The string 13 is switched as required between the high impedance and ground states by a string enable sequencer 40. This function will be described in more detail below.

On a typical guitar, the musician sometimes plays chords where one or more of the strings are required not to sound. To accomplish this, the musician allows one of his fretting fingers to touch the appropriate string, thus muting the sound. It is desirable in the multiple-string parallel keyboard configuration to have a similar action available. Since no string vibration occurs, however, an alternate method is required. The method used is to measure the resistance of the user's fingers if they bridge two strings 13. More specifically, the string enable sequencer 33 enables one string (provides 0 volts) and the fret pair detector determines what frets if any are depressed as already described. If no frets are depressed, then the user is either playing an open note or has muted the string. In this case, to detect muting, an additional operation is provided whereby the string enable sequencer provides zero volts (ground) to the adjacent strings 13 and a high impedence to the string 13 being interrogated. The touch detector 37 then measures the resistance of the selected string to ground. If 2–10 megaohms of resistance is detected by the touch detector, the string 13 being interrogated is being bridged by a finger and the gate is cleared such that no tone is allowed to be produced. If an open circuit is seen, then an open tone is allowed to be produced.

Another feature useful for the multi-string mode is an improved method of fully muting a chord by properly lowering (clearing) the gate signals for each string when the musician has ceased playing that chord. The OCO detector works well to control gate operation with single string melodies but in chord playing there are certain situations where some of the notes in the chord are closed and some of the notes are open. In these situations, it is not convenient to release all closed notes and then close all open notes in order to end the chord. Although it is possible to use the mute strategy of measuring the bridged finger resistance as previously described to mute the open notes of the chord, that strategy is used most effectively for preventing unwanted open notes from sounding at all when striking a chord initially.

Hence, an improved strategy may be provided to control the ending of a chord. A mute controller provided by the micro-processor 140 accomplishes this end-of-chord control. The mute controller monitors the gate condition (set or clear) of all six strings and the notes associated with each string as to whether they are open or closed. When the mute controller detects a mixture of open and closed notes on the strings, it overrides the OCO detector to clear necessary gates in two cases. First, when a mixture of open and closed notes are present and then all closed notes go open, the gates of all the open notes are also cleared to fully terminate the chord. Second, when only open strings are present than detection of any one of the opens going closed will clear all other opens. In either case, the OCO detector still clears the gates of those strings which actually experience a change in their open/close status.

Hence, after an initial trigger due to a pluck of the string, the touch detector 37 is employed to detect whether the string should be allowed to sound at all. After the correct strings in the chord have sounded, the mute controller serves to control clearing of the sounding strings when the chord is released. In the microprocessor embodiment, the string enable sequencer operation and mute controller operation are incorporated into the micro-processor 140, while the touch detector circuit is external to the processor.

According to another feature useful in the multiple-string embodiment certain fret segments are wired together in an advantageous way, saving extensive hardware.

In a six by sixteen matrix of the parallel keyboard, there are ninety individual fret positions plus six open string positions. In order to send the controller information on each string and its depressed frets, one might initially use six 16:1 multiplexers (one multiplexer for each string). A second approach might be to use a single 16:1 multiplexer and diodes to "or" the individual frets into the multiplexer. Isolation diodes are required since if two or more frets are touched simultaneously, invalid results may be obtained. This requires 96 diodes and one multiplexer. A third way is to wire all corresponding notes together—that is, fret 1 of string 1 wired to fret 6 of string 2, etc. since they are all "F" notes. This would require a 40:1 multiplexer and no diodes.

Figure 15:
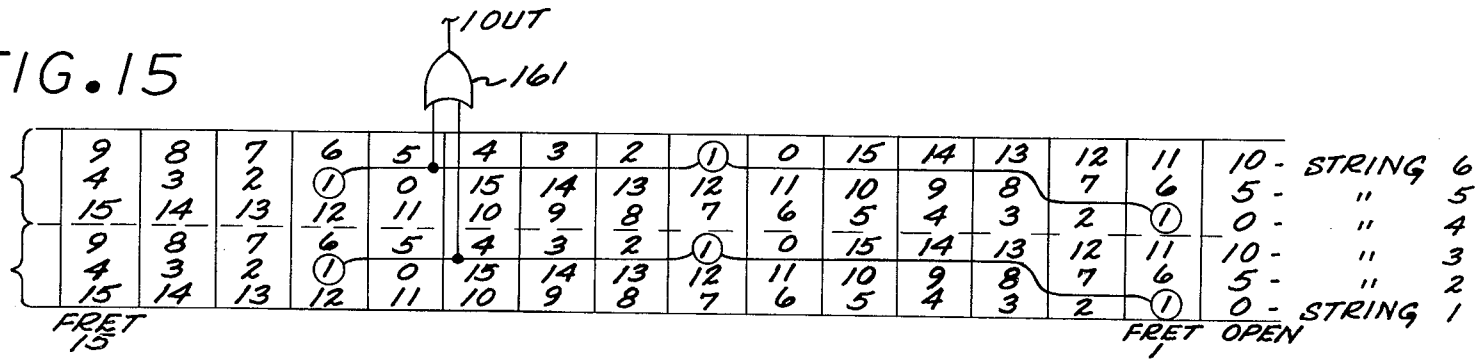
FIG. 15 illustrates a multiplexing fret assignment scheme useful with the preferred embodiments.

A much more efficient and novel method of minimizing the hardware relies on some physical constraints that are imposed on the musician—that is, if the musician is touching one section of the neck, he cannot possibly be touching another section if that second section is beyond the reach of his fingers. The limit is preferably set to be five frets. Therefore, the neck is ordered in such a way that no fret having an assignment of one number can be within five frets of another fret also so assigned. To make this clear, the full assignment matrix is shown in FIG. 15.

Note that string 1 is numbered 0–15 with 0 being open. On string 2, all numbers are slipped by 5 such that a player cannot touch two of the same number. String 3 is slipped by 5 more to insure that same constraint is true. The upper three strings are therefore subject to being touched by the user simultaneously and therefore may create errors. Therefore, the block of strings 1–3 are separated from the block of strings 4–6 by OR-ing circuits such as OR circuit 161. That is, both number one blocks are OR-ed into multiplexer position one, both number two blocks are OR-ed into multiplexer position two, etc. In this way the processor, knowing what string is being interrogated, can determine what fret is depressed. The above method is done in the processor 140 by pre-setting the fret scan generator with the assigned number of the 15th fret. That is, string 1 would be "15", string 2 would be "4", string 3 would be "9", etc. The scan then continues downward from this number (cycling through "0" then to "15" as required) until all 16 multiplexer inputs have been interrogated or until a valid string depression is found. The processor 140 converts the scan number to the note number by counting the number of decrements required to find a depression up to a maximum of 16.

To illustrate further, on string 2, the 15th fret has a scan number of four. This means that the 4th input of the multiplexer 35 is connected to fret 15 under string 2. When string 2 is interogated, the scanner, port 2, initially presents the multiplexer 35 with a code representing "4". The micro-processor 140 maintans a counter running in parallel with the scanner which begins at "15" each time, regardless of which string is interrogated. Hence, if in response to code "4", a valid string depression on the second string is indicated, the processor 140 supplies the code representing note "15" to the synthesizer. If the scanner counts from "4" to "2", the parallel counter in the processor decrements from "15" to "13," indicating that if the multiplexer output 43 is energized by the second input to the multiplexer, the correct note is represented by the code for note "13."

To complete the set of features available, a bending control 87 may be provided for "bending" of notes—that is changing the frequency of a played note up or down. Most guitarists have a bar on their guitar which mechanically changes the tension on the strings to alter the frequency. On the parallel keyboard, the same effect is achieved by having a lever connected to a spring-loaded potentiometer 88 which outputs to the converter 67 (FIG. 3). Pushing the rod 87 in one direction generates a voltage that causes the synthesizer to modify its frequency higher—pushing in the opposite direction causes the opposite effect.

In general, many modifications and adaptations of the invention may be made without departing from its scope and spirit. Hence, it is to be understood that, within the scope of the appended claims, the invention may be practiced other than as specifically described above.

What is claimed is:

1. Musical apparatus for use with a synthesizer comprising:

a fret bearing surface having at least one string stretched over a plurality of frets, each of said frets representing a particular musical note; and means for providing a signal indicative of the note represented by a particular selected fret to said synthesizer, said means being operative to detect whether or not said string is depressed against said particular fret and against the next adjacent fret and to provide said signal only if both said particular fret and said adjacent fret are detected as having the string depressed against them.

2. The apparatus of claim 1 further including means for detecting a slide or hammer movement on said fret bearing surface and responsive to detection of the slide or hammer movement to alter said signal to said synthesizer.

3. The apparatus of claim 1 or 2 wherein said strings may be plucked in either an open or closed position further including means for detecting a change in the open/closed status of said string after provision of said signal and responsive to such detection to inhibit a change in said signal.

4. A musical instrument comprising:

a fret bearing surface having at least one string stretched over a plurality of frets;

means for detecting depression of said string against a particular said fret and providing an output signal corresponding to each fret having said string depressed against it;

means for generating a plurality of select codes; each select code identifying a particular fret, such that for each output signal which may be produced there is a corresponding select code;

means supplied with said output signals and said fret select codes and responsive to a first said output signal to latch a first select code which corresponds to said first output signal, and further responsive to a second said output signal whose corresponding select code identifies the fret next to the fret identified by said first select code to produce a first control signal; and means responsive to at least said first control signal for latching the select code representative of the note actually selected on said fret bearing surface.

5. The instrument of claim 4 further including a trigger signal generator means responsive to plucking of said at least one string to generate a trigger signal at the time of plucking and wherein said means for latching includes slide timer means for timing an interval after said trigger signal during which note selection is permitted.

6. The instrument of claim 4 wherein said string is pluckable in either an open or closed position and wherein said means for latching further includes means for detecting a change in the open/closed status of the string.

7. In a device for controlling a synthesizer from a stringed instrument, the apparatus comprising;

a fret board having a note ordering assignment wherein each fret is assigned a corresponding number and wherein no fret having an assignment of one given number is within a fixed distance of frets having the same number, said distance being chosen such that frets having the same number are beyond reach of the player's fingers.

8. The apparatus of claim 7 wherein said note ordering assignment is maintained in the memory of a microprocessor means and wherein said micro-processor means scans said fret board, generates a scan number for each fret, and converts said scan number to the correct said corresponding number.

9. For use with a device for controlling a synthesizer from a fretted, stringed instrument, a method of providing a correct note indication to said synthesizer including the steps of:

successively examining each fret beneath a selected string to detect whether a said string is depressed against one or more frets; and selecting a note indication for supply to said synthesizer only after detecting that first and second adjacent frets have the string depressed against them.

10. Musical apparatus for use with a synthesizer comprising:

a fret bearing surface having at least one string stretched over a plurality of frets, each of said frets representing a particular musical note; and means including first and second storage locations for providing a signal indicative of the note represented by a particular selected fret to said synthesizer, said means being operative to sequentially scan said frets, detect whether or not said string is depressed against a particular fret, store in said first location a code representative of the first fret against which a string is detected as depressed, and transfer said code to said second storage location upon detection of the string being depressed against the fret adjacent to said first fret.

11. The apparatus of claim 10 wherein said means is further operative to cease scanning of the string and preclude transfer to said second storage location upon detecting that the string is not depressed against said adjacent fret.

12. The apparatus of claim 10 or 11 wherein if all frets underlying one string are scanned without detection of two adjacent depressed frets or a single depressed fret, said means is operative to pass a code representing an open note to said second storage location.

* * * * *